United States Patent [19]

Alasio

[11] Patent Number: 4,895,208

[45] Date of Patent: Jan. 23, 1990

[54] ELEVATOR CAB FIRE EXTINGUISHING SYSTEM

[76] Inventor: Victor Alasio, 196 Palisade Ave., Cliffside Park, N.J. 07010

[21] Appl. No.: 247,711

[22] Filed: Sep. 22, 1988

[51] Int. Cl.[4] ..... A62C 35/02; A62C 37/12; G08B 17/04

[52] U.S. Cl. ..... 169/54; 169/56; 169/57; 169/62; 169/26; 169/9; 169/23

[58] Field of Search ..... 169/54, 56, 57–59, 169/61, 62, 9, 19, 26, 38, 70, 51, 49, 47, 60; 187/1 R, 105

[56] References Cited

U.S. PATENT DOCUMENTS

| | | | |
|---|---|---|---|
| 1,826,767 | 10/1931 | Geiger | 169/54 |
| 3,245,474 | 4/1966 | Romero | 169/26 |
| 3,773,145 | 11/1973 | Drexler | 187/105 |
| 4,487,266 | 12/1984 | Gillis et al. | 169/56 X |

FOREIGN PATENT DOCUMENTS

| | | | |
|---|---|---|---|
| 3132528 | 3/1983 | Fed. Rep. of Germany | 169/9 |

*Primary Examiner*—Joseph F. Peters, Jr.
*Assistant Examiner*—James M. Kannofsky
*Attorney, Agent, or Firm*—Samuelson & Jacob

[57] ABSTRACT

An elevator cab fire extinguishing system is carried by an elevator cab and is arranged to discharge a non-toxic fire extinguishing agent into the interior of the elevator cab in response to a fire in the elevator cab to extinguish the fire quickly and without harm to passengers and property present in the elevator cab, and includes controls responsive to the discharge of the fire extinguishing agent for automatically shutting down the ventilation fan of the elevator cab, sounding an audible alarm, and delivering the elevator cab to a designated egress level in the building within which the elevator cab travels.

9 Claims, 2 Drawing Sheets

ELEVATOR CAB FIRE EXTINGUISHING SYSTEM

The present invention relates generally to fire safety, and pertains, more specifically, to the protection of passengers and property in elevator cabs from the ravages of fire.

While much attention has been given to fire prevention in buildings of all kinds, and to the provision of fire escape devices and procedures, and fire fighting systems designed to protect property as well as occupants in buildings, very little effort has been expended in providing for the safety of passengers and property in elevator cabs. As a result, over the years, fires in elevator cabs have been the cause of grievous injury, and even death, as well as a great deal of property damage. Experience has shown that most elevator fires occur within the elevator cab itself, and are the result of flammable items in the elevator cab which either ignite accidentally or are ignited by vandalic acts. When such fires do occur, passengers usually are present in the cab and are subjected to devastating injury, and even death. It would be advantageous to have available a simple, yet reliable system for extinguishing a fire in an elevator cab, with safety, in order to prevent injury to passengers unfortunate enough to be present in the elevator cab at the outbreak of the fire.

The present invention provides a simple and effective system for extinguishing a fire in an elevator cab quickly and with safety to passengers in the cab, and attains several objects and advantages, some of which may be summarized as follows: Immediate and effective response to the presence of a fire in an elevator cab, to extinguish the fire quickly; rapid extinguishing of a fire in an elevator cab with safety to passengers in the cab and minimal damage to property; automatic operation for almost instantaneous response without the necessity for the actuation of any control by a passenger; versatility of installation so as to meet the requirements of almost any elevator system; and simple and low-cost operation and maintenance for encouraging widespread use with economy.

The above objects, as well as further objects and advantages, are attained by the present invention, which may be described briefly as an elevator cab fire extinguishing system for use in extinguishing a fire within the interior of the cab of an elevator in response to the presence of the fire itself, the elevator cab fire extinguishing system comprising: a source of non-toxic fire extinguishing agent maintained under superatmospheric pressure; a conduit communicating with the source and the interior of the elevator cab; and a valve in the conduit, the valve including temperature-responsive means associated with the interior of the elevator cab for maintaining the conduit closed in the presence of normal operating conditions in the interior of the elevator cab and for opening the conduit in response to a high temperature condition associated with a fire within the interior of the elevator cab to discharge the fire extinguishing agent from the source into the interior of the elevator cab.

The invention will be understood more fully, while still further objects and advantages will become apparent, in the following detailed description of preferred embodiments of the invention illustrated in the accompanying drawing, in which.

Figure 1:
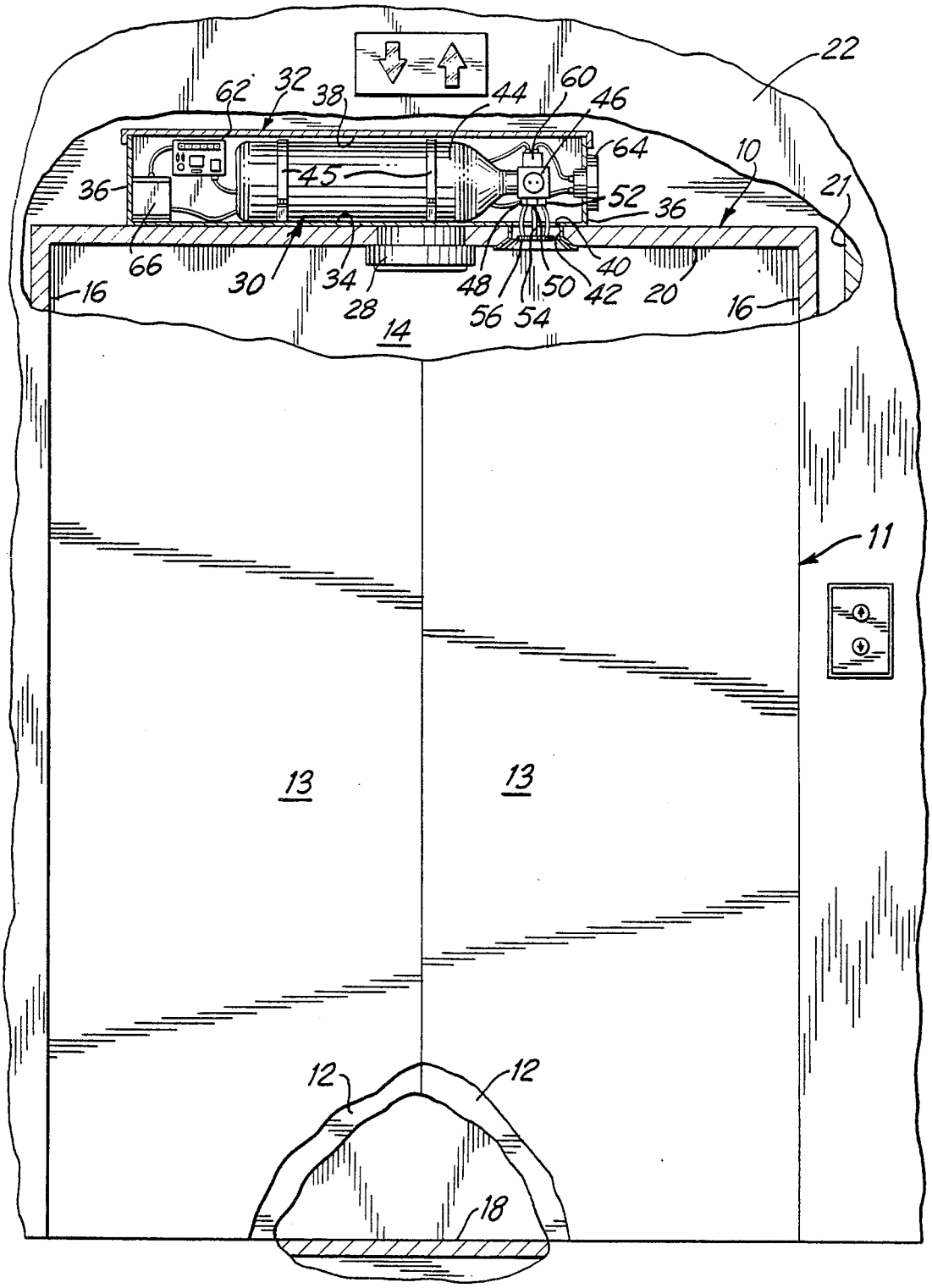
FIG. 1 is a pictorial illustration, partially broken away, of a fire extinguishing system constructed in accordance with the invention and installed in a conventional elevator cab.
Figure 2:
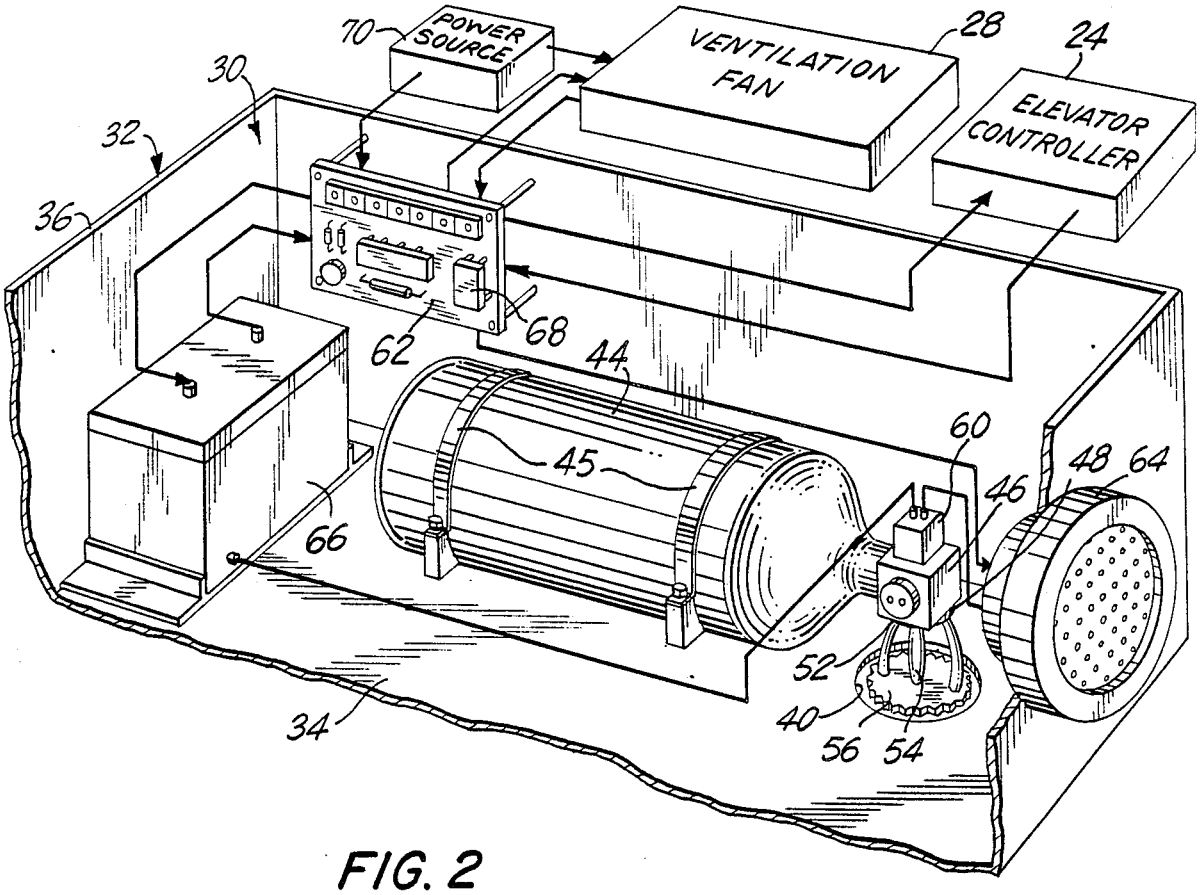
FIG. 2 is a partially diagrammatic perspective view of the fire extinguishing system.

Turning now to the drawing, and especially to FIGS. 1 and 2 thereof, an elevator cab 10 of an elevator 11 of the type employed in connection with the transport of passengers has a pair of elevator cab doors 12 placed behind hoistway doors 13 and leading to the interior 14 of the elevator cab 10, the interior 14 being bounded by side walls 16, a floor 18 and a ceiling 20. Elevator cab 10 traverses several stories, or levels, within an elevator shaft 21 of a building 22 within which the elevator 11 is installed, under the control of an elevator controller 24 placed in a remote location in the building 22, usually in a motor room (not shown) provided for the purpose. A ventilation fan 28 is located adjacent the ceiling 20 and normally operates to maintain adequate ventilation within the elevator cab 10 for the comfort and safety of passengers using the elevator. The present invention provides a fire extinguishing system 30 for use in connection with the elevator cab 10 for the safety and protection of the passengers.

Fire extinguishing system 30 includes an enclosure 32 mounted upon and secured to the elevator cab 10, preferably outside the elevator cab 10 at the ceiling 20, the enclosure 32 having a base 34, side walls 36 and an access cover 38. It is best that the enclosure 32 be constructed of a sturdy, fireresistant material, a suitable material being stainless steel. An aperture 40 in the base 34 is juxtaposed with a passage 42 through the ceiling 20 so that the interior 14 of the elevator cab 10 is accessible to the fire extinguishing system 30, as will be explained in detail below.

A source of fire extinguishing agent is located in the enclosure 32 and is seen to include a container in the form of a cylinder 44 of fire extinguishing fluid held under superatmospheric pressure within the cylinder 44. Cylinder 44 is secured in place within the enclosure 32 by hold-down brackets 45 and includes a fitting 46 which provides a conduit juxtaposed with the aperture 40 and the passage 42 in the ceiling 20 of the elevator cab 10. Discharge means is shown in the form of a discharge head 48 affixed to the fitting 46 and located at the passage 42, the fitting 46 including a discharge orifice at 50 aimed so as to enable the discharge of fire extinguishing agent from the cylinder 44 into the interior 14 of the elevator cab 10. A valve 52 maintains the discharge orifice 50 normally closed so that the fire extinguishing fluid is confined within cylinder 44 awaiting use. Valve 52 is of the type which is actuated in response to a change in temperature, and includes temperature-sensitive means in the form of a fusible link 54 juxtaposed with the passage 42 so as to be in direct communication with the interior 14 of the elevator cab 10. A deflector plate 56 is a part of the discharge head 48.

Should there be a fire in the elevator cab 10, the temperature in the interior 14 of the elevator cab 10 will rise. Very shortly, the temperature at the ceiling 20 will reach that which will cause the fusible link 54 to melt, thereby opening valve 52 and discharging fire extinguishing fluid from the cylinder 44 into the interior 14 of the elevator cab 10. The temperature at which the fusible link 54 will melt is about 165° F., and that temperature is reached very quickly, so that the fire extinguishing system 30 reacts very quickly to flood the interior 14 of the elevator cab 10 with fire extinguishing agent and extinguish the fire. Distribution of the fire extinguishing fluid will be aided by the deflector plate 56 and in a very short time the fire will be extinguished. The fire extinguishing agent is chosen from available non-toxic fire extinguishing agents. The preferred agent is a bromotrifluoromethane, available commercially under the trademark HALON, and more particularly HALON 1301, which exhibits the necessary fire extinguishing characteristics and has no toxic effects upon the passengers in the elevator cab 10.

As soon as the fire extinguishing fluid is discharged from the cylinder 44, a sensor in the form of a pressure-sensitive switch 60 in fitting 46 is actuated in response to the drop in pressure in the fitting 46. As best seen in FIG. 2, switch 60 is connected to a control circuit 62 which performs several functions in response to the actuation of switch 60. First, the control circuit 62 shuts down the ventilation fan 28 so that the fire extinguishing fluid is not exhausted from the elevator cab 10 before the fire can be extinguished. In addition, the ventilation fan 28 is precluded from introducing more oxygen to the fire in the elevator cab 10. Control circuit 62 also activates an audible alarm in the form of a siren 64 to apprise others in the building 22 of the fire. Further, control circuit 62 is connected t the elevator controller 24 and automatically activates the elevator controller 24 to shift the elevator controller to the mode known as "Phase I" fire operation, a standardized operating mode in which the elevator cab 10 is delivered to the level in the building 22 designated as the egress floor, or level, which ordinarily is the lowest terminal landing and, upon arrival of the elevator cab 10 at the designated egress level, the elevator doors 12 are opened automatically to enable safe egress of the passengers. When the elevator mode of operation is shifted to Phase I fire operation, the emergency stop switch (not shown) of the elevator is disabled automatically, thereby preventing manual actuation of the emergency stop switch by a passenger and assuring that the elevator cab 10 will be delivered to the designated egress level without delay. Once the emergency is passed, the system 30 is deactivated, the exhausted cylinder 44 is removed and is replaced with a fully-charged cylinder so that the system once again is fully functional, with minimal interruption in elevator operation and in the protection afforded by the system 30.

The fire extinguishing system 30 is entirely self-contained and the above-described control functions are powered by a rechargeable battery 66. Preferably, battery 66 is a standard twelve-volt battery and a battery charger 68, powered by an external source 70 of electrical power, is controlled by control circuit 62 to maintain battery 66 at full charge, in readiness for activation of the control functions of the system 30 upon demand. It is noted, however, that no electrical power is needed to activate the system 30 to extinguish a fire in the elevator cab 10 since valve 52 is opened solely in response to the presence of the fire and requires no electrical power to discharge the fire extinguishing agent into the interior 14 of the elevator cab 10.

Figure 3:
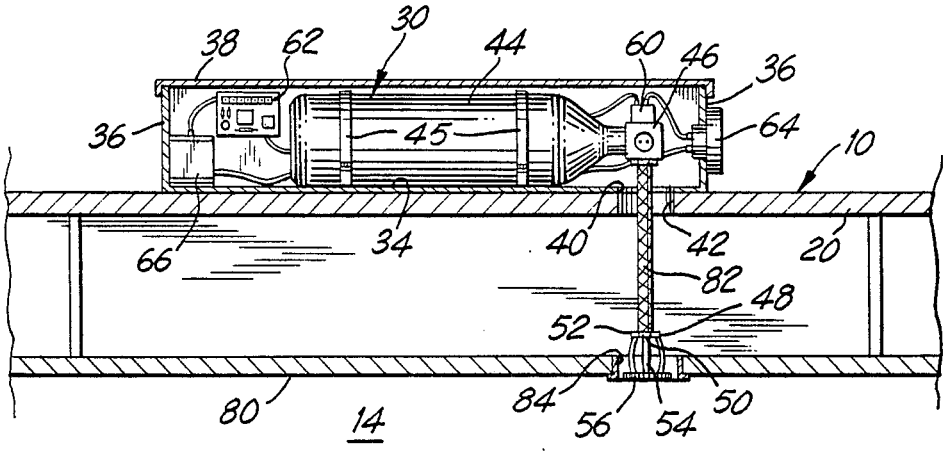
FIG. 3 is an elevational, cross-sectional fragmentary view of an alternate installation.

Turning now to FIG. 3, an alternate installation is illustrated. In the installation of FIG. 3, the elevator cab 10 is of the type provided with a dropped ceiling 80 below the outer ceiling 20 of the elevator cab 10. The fire extinguishing system 30 is installed above the ceiling 20, as described above; however, a flexible extension 82 is connected between the fitting 46 and the discharge head 48 to extend the conduit between the cylinder 44 and the interior 14 of the elevator cab 10 so that the discharge head 48 is located at a passage 84 through the dropped ceiling 80. In this manner, the temperature-sensitive means is located for quick response to the conditions in the interior 14 of the elevator cab 10 and the discharge head 48 will deliver discharged fire extinguishing fluid effectively to the interior 14 of the elevator cab 10, should a fire occur. Thus, it will be seen that the fire extinguishing system 30 is adapted readily to a variety of site requirements.

It will be apparent that the fire extinguishing system 30 provides a safe and effective means for protecting passengers as well as property in an elevator cab from the ravages of a fire in the elevator cab itself. The system responds quickly and effectively to extinguish any such fire before extensive harm can occur. The system is simple and is easily installed and readily maintained with economy, so that widespread use is encouraged, resulting in increased safety and confidence on the part of elevator passengers.

It is to be understood that the above detailed description of preferred embodiments of the invention are presented by way of example only. Various details of design and construction may be modified without departing from the true spirit and scope of the invention as set forth in the appended claims.

The embodiments of the invention in which an exclusive property or privilege is claimed are defined as follows:

1. An elevator cab fire extinguishing system for use in extinguishing a fire within the interior of the cab of an elevator in response to the presence of the fire itself, the elevator cab fire extinguishing system comprising:

a source of non-toxic fire extinguishing agent maintained under superatmospheric pressure;

a conduit communicating with the source and the interior of the elevator cab; and a valve in the conduit, the valve including temperature-responsive means associated with the interior of the elevator cab for maintaining the conduit closed in the presence of normal operating conditions in the interior of the elevator cab and for opening the conduit in response to a high temperature condition associated with a fire within the interior of the elevator cab to discharge the fire extinguishing agent from the source into the interior of the elevator cab.

2. The invention of claim 1 wherein the non-toxic fire extinguishing agent is a bromotrifluoromethane.

3. The invention of claim 1 wherein the elevator cab includes a floor, side walls and a ceiling, and the source of non-toxic fire extinguishing agent includes a container and a discharge head associated with the container, the discharge head having a discharge means for directing the discharged fire extinguishing agent, and the elevator cab fire extinguishing system includes means for mounting the container and the discharge head upon the elevator cab such that the discharge means will discharge the fire extinguishing agent into the interior of the elevator cab adjacent the ceiling thereof.

4. The invention of claim 3 wherein the temperature-responsive means includes a fusible link located adjacent the ceiling of the elevator cab when the elevator cab fire extinguishing system is mounted upon the elevator cab.

5. The invention of claim 1 wherein the elevator cab includes a ventilation fan normally in operation during the operation of the elevator cab, and the elevator cab fire extinguishing system includes control means having sensor means responsive to the discharge of fire extinguishing agent into the interior of the elevator cab for shutting down the operation of the ventilation fan upon discharge of the fire extinguishing agent into the interior of the elevator cab so as to maintain sufficient fire extinguishing agent in the interior of the elevator cab to extinguish the fire without delay.

6. The invention of claim 5 wherein the control means includes an electrical circuit for controlling operation of the ventilation fan and the sensor means includes a pressure-responsive switch capable of actuation in response to the pressure in the conduit upon discharge of the fire extinguishing agent.

7. The invention of claim 1 including audible signal means and control means having sensor means responsive to the discharge of fire extinguishing agent into the interior of the elevator cab for actuating the audible signal means.

8. The invention of claim 1 wherein the elevator includes a controller for controlling movement of the elevator cab among a plurality of levels, the elevator cab fire extinguishing system including control means responsive to the discharge of fire extinguishing agent into the interior of the elevator cab for operating the controller to move the elevator cab to a designated egress level upon the discharge of the fire extinguishing agent.

9. The invention of claim 8 wherein the elevator cab includes doors and the control means operates the controller, in response to the discharge of the fire extinguishing agent, to preclude selective opening of the elevator cab doors by passengers until the elevator cab arrives at the designated egress level.

* * * * *